US007830224B2

(12) United States Patent
U-Yen et al.

(10) Patent No.: US 7,830,224 B2
(45) Date of Patent: Nov. 9, 2010

(54) COMPACT MAGIC-T USING MICROSTRIP-SLOTLINE TRANSITIONS

(75) Inventors: Kongpop U-Yen, Alexandria, MD (US); Edward J. Wollack, Clarksville, MD (US); Terence Doiron, Annapolis, MD (US); Samuel H. Moseley, University Park, MD (US)

(73) Assignee: The United States of America as represented by the Administrator of the National Aeronautics and Space Administration, Washington, DC (US)

( * ) Notice: Subject to any disclaimer, the term of this patent is extended or adjusted under 35 U.S.C. 154(b) by 0 days.

(21) Appl. No.: 11/877,102

(22) Filed: Oct. 23, 2007

(65) Prior Publication Data

US 2009/0102577 A1 Apr. 23, 2009

(51) Int. Cl.
*H01P 5/20* (2006.01)
*H01P 3/08* (2006.01)

(52) U.S. Cl. ..... 333/121; 333/128; 333/161

(58) Field of Classification Search ..... 333/117, 333/118, 121, 122, 246, 128, 161
See application file for complete search history.

(56) References Cited

U.S. PATENT DOCUMENTS

| | | | |
|---|---|---|---|
| 4,383,227 | A | 5/1983 | de Ronde |
| 4,636,757 | A | 1/1987 | Harrison et al. |
| 5,075,647 | A | 12/1991 | Petter |
| 5,278,575 | A | 1/1994 | Thomas |
| 5,303,419 | A | 4/1994 | Ittipiboon et al. |
| 5,422,609 | A | 6/1995 | Ho et al. |
| 5,966,058 | A | 10/1999 | Davidovitz |
| 5,986,519 | A | 11/1999 | Kellett et al. |
| 6,639,484 | B2 | 10/2003 | Tzuang et al. |
| 6,794,950 | B2 | 9/2004 | du Toit et al. |
| 6,946,880 | B2 | 9/2005 | Essenwanger |

OTHER PUBLICATIONS

Kongpop U-Yen et al., "A Compact Low-Loss Magic T-Using Microstrip-Slotline Transitions" Microwave Symposium , IEEE/MTT-S International, Jun. 3-8, 2007, p. 37-40, Honolulu, Hawaii.

*Primary Examiner*—Dean O Takaoka
(74) *Attorney, Agent, or Firm*—Christopher O. Edwards

(57) ABSTRACT

The design of a compact low-loss Magic-T is described. The planar Magic-T incorporates a compact microstrip-slotline tee junction and small microstrip-slotline transition area to reduce slotline radiation. The Magic-T produces broadband in-phase and out-of-phase power combiner/divider responses, has low in-band insertion loss, and small in-band phase and amplitude imbalance.

11 Claims, 8 Drawing Sheets

COMPACT MAGIC-T USING MICROSTRIP-SLOTLINE TRANSITIONS

ORIGIN OF THE INVENTION

The invention described herein was made by employees of the United States Government and may be manufactured and used by or for the government for government purposes without payment of any royalties thereon or therefore.

FIELD OF THE INVENTION

This invention relates to microwave devices, especially Magic-Tee or Magic-T couplers, and more particularly, to a device suitable for use in radar and communications systems.

BACKGROUND

Planar Magic-Ts are used in microwave integrated circuits to split or combine in-phase and out-of-phase signals. Applications include balanced-mixers, discriminators, interferometers, and beam-forming networks. Desirable properties of a magic-T include wide bandwidth phase and amplitude balance, low insertion loss, high isolation, compact size, and fabrication simplicity.

Several techniques have been developed to provide broadband response to a Magic-T. Co-planar waveguide (CPW) or microstrip (MS) to slotline (SL) mode conversion techniques are widely incorporated in a Magic-T to produce a broadband out-of-phase power combiner or divider such that the slotline transmission becomes the main part of these Magic-Ts. Since a slotline has less field confinement than a microstrip or a CPW, slotline radiation can cause high insertion loss in these Magic-Ts. In addition, the Magic-T constructed from CPW transmission lines requires the bonding process for air bridges which increases fabrication complexity. Although aperture coupled Magic-Ts have a small slot area, however, aperture coupled Magic-Ts require three metal layers causing high insertion loss and radiation.

For at least the reasons stated above, and for other reasons stated below which will become apparent to those skilled in the art upon reading and understanding the present specification, there is a need in the art for Magic-T is compact and has less slotline radiation loss. There is also a need for improved Magic-T with reduced slotline radiation.

SUMMARY

The above-mentioned shortcomings, disadvantages and problems are addressed herein, which will be understood by reading and studying the following specification.

The invention uses the complementary properties of microstrip and slotline to produce a compact broadband out-of-phase combining structure with minimum loss due to slot line radiation. The structure has low loss and is highly symmetric which causes the structure to be less dependent on the transmission line phase variation. As a result, the structure has high port E-H isolation, extremely high phase balance, and has broadband response. The overall bandwidth is mainly limited by the slotline termination and the impedance transformation at the port. The ability to combine signal using only transmission line and slotline without incorporating complex fabrication processes such as bondwires, viaholes or air-bridges.

In one aspect, the invention provides a microwave circuit arrangement having a Magic-T waveguide circuit element with a first and second input port and an output port, a microstrip slotline transition circuit with an input/output port, and a slotline coupling the Magic-T waveguide circuit element and the microstrip slotline transition circuit.

In another aspect, the invention provides a microwave circuit arrangement having a Magic-T waveguide circuit element with a first and second input port and an output port, a microstrip slotline transition circuit with an input/output port, a slotline coupling the Magic-T waveguide circuit element and the microstrip slotline transition circuit, a first slotline stepped circular ring positioned within the Magic-T waveguide circuit and coupled to one end of the slotline, and a second slotline stepped circular ring positioned within the microstrip slotline transition circuit and coupled to one end of the slotline.

In still another aspect, the invention provides a microwave circuit arrangement having a Magic-T waveguide circuit element, a microstrip slotline transition circuit, a slotline for forming a microstrip slotline tee junction, and a microstrip stepped impedance opened (SIO) stub coupled to one end of the microstrip slotline transition circuit.

In another embodiment, the invention is a four-port circuit for processing two incoming signals of arbitrary phase and amplitude. The four-port circuit provides a first input port and a second input port for receiving respective first and second incoming signals of arbitrary phase and amplitude, and a first output port and second output port. Further, a slotline having a first and second end terminated with slotline stepped circular ring (SCR) to combine the first and second incoming signals at a junction node when the signals are out-of-phase, and combined the first and second incoming signals at the first output port when the signals are in-phase.

Apparatus, systems, and methods of varying scope are described herein. In addition to the aspects and advantages described in this summary, further aspects and advantages will become apparent by reference to the drawings and by reading the detailed description that follows.

DETAILED DESCRIPTION

In the following detailed description, reference is made to the accompanying drawings that form a part hereof, and in which is shown by way of illustration specific embodiments which may be practiced. These embodiments are described in sufficient detail to enable those skilled in the art to practice the embodiments, and it is to be understood that other embodiments may be utilized and that logical, mechanical, electrical and other changes may be made without departing from the scope of the embodiments. The following detailed description is, therefore, not to be taken in a limiting sense.

Figure 1:
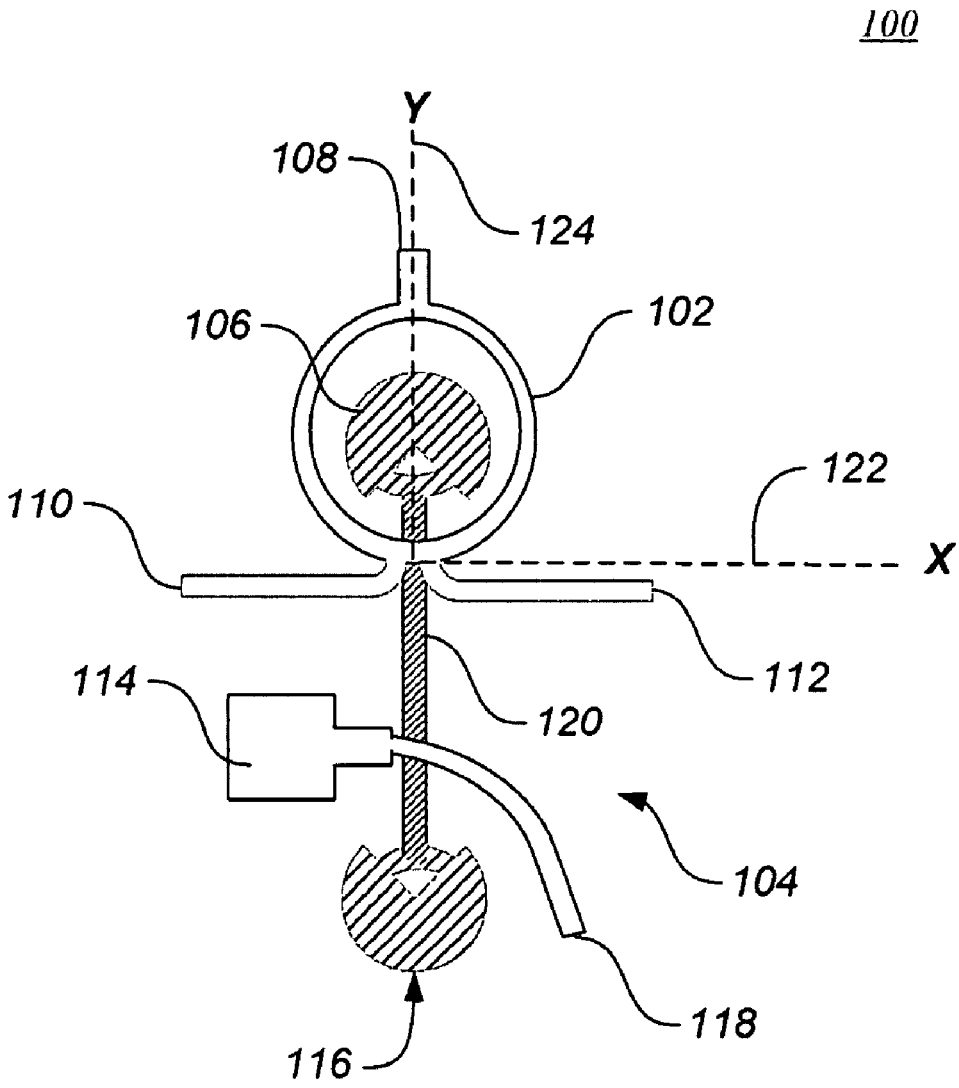
FIG. 1 is a diagram of a Magic-T in accordance to an embodiment.

FIG. 1 is a representation of a Magic-T 100 according to an embodiment. The magic-T 100 comprises five λ/4 microstrip lines with characteristic impedances of $Z_1$, $Z_2$ and $Z_t$. The illustrated magic-T 100 requires only one short section of the MS-to-SL transition to achieve a broadband 180 degree phase shift and an out-of-phase power combiner. Additionally, the magic-T 100 structure has a small total slotline area, thus minimizing radiation loss and parasitic coupling to microstrip lines. The magic-T layout is also symmetric along the Y-axis 124 up to sum port 108. As a result, the parasitic coupling from slotline sections to microstrip line sections at port 110 and port 122 are substantially equal. Thus, the sum port 108 and difference port 118 isolation of the magic-T 100 exhibits broad-band characteristics. Moreover, the magic-T 100 does not require via holes, bondwires or airbridges which increase fabrication complexity and allow broadband operation in millimeter wave frequency. It also comprises a slotline (120) of length Ls with the slotline characteristic impedance of Zs. All ports are terminated with the microstrip lines with the characteristic impedance of $Z_0$. The slotline 120 section is terminated with the slotline SCR termination (106, 116) at both ends to provide broadband and low-loss MS-to-SL transition and to allow out-of-phase combining to occur. Impedance $Z_t$ is used to transform slotline Zs to the microstrip line $Z_0$ at the difference port 118. The Magic-T (Magic-TEE) 100 comprises a Magic-T waveguide circuit element 102 having input ports 110 and 112 and a first slotline stepped circular ring (SCR) 106; and, microstrip-slotline (MS-SL) junction having an input/output port 118 that ends with a microstrip stepped impedance open end (SIO) stub, and a second SCR 116. Additionally, the first and second SCR are connected by slotline 120. The Magic-T (Magic-TEE) 100 includes quarter-wavelength (λ/4) microstrip lines with the characteristic impedances of $Z_1$, $Z_2$ and $Z_t$. The $Z_1$ line with the length of $L_1$ is used to transform the characteristic impedance $Z_o$ at port 1 (110) or port 2 (112) to a slotline impedance (Zs) at the center of the structure (Axis Y, 124), $Z_1$ and $Z_t$, lines (with the length of $L_1$ and $L_2$, respectively) are used for transforming impedance from slotline impedance to $Z_o$ at the sum port or port H (port 108) and at the difference port or port E (port 118), respectively. The magic-T 100 also includes slotline 120 (Zs), with the length of $L_s$. One end of the $Z_t$ line (port 118) is terminated with a microstrip stepped impedance open-end (SIO) stub 114 to produce a broadband virtual ground for the MS-SL transition. The SIO stub 114 includes microstrip lines with the characteristic impedances of $Z_{T1}$ and $Z_{T2}$ and the associated parameters describing widths and lengths ($\theta_{T1}$ and $\theta_{T2}$).

The ends of the slotline, having impedance $Z_S$, are coupled to slotline stepped circular ring (SCR) 106 and 116 to provide broadband and low-loss MS-SL transition and to allow out-of-phase combining at MS-SL tee junction 204 along the X-plane 122 of the Magic-T waveguide circuit element 102. The signals from the first port 110 and the second port 112 are combined out-of-phase at the MS-SL tee junction along X-plane and combined in-phase at output port 108.

A slotline termination (120, 106) is used at the MS-SL tee junction to provide a slotline virtual open and allow mode conversion in the out-of-phase combiner. It is also used in the MS-SL transition at input/output port 118 (port E). A slotline SCR termination is used in the Magic-T waveguide circuit element 102 due to its compact size and because the slotline SCR termination (106) minimizes the effect of parasitic and slotline radiation in slotline 120. While Magic-T 100 has been described with planar waveguide circuits, it should be understood by those in the art that planar alternatives can be used such as retrace hybrid and planar magic-Ts using microstrip-coplanar waveguide transitions.

Figure 2:
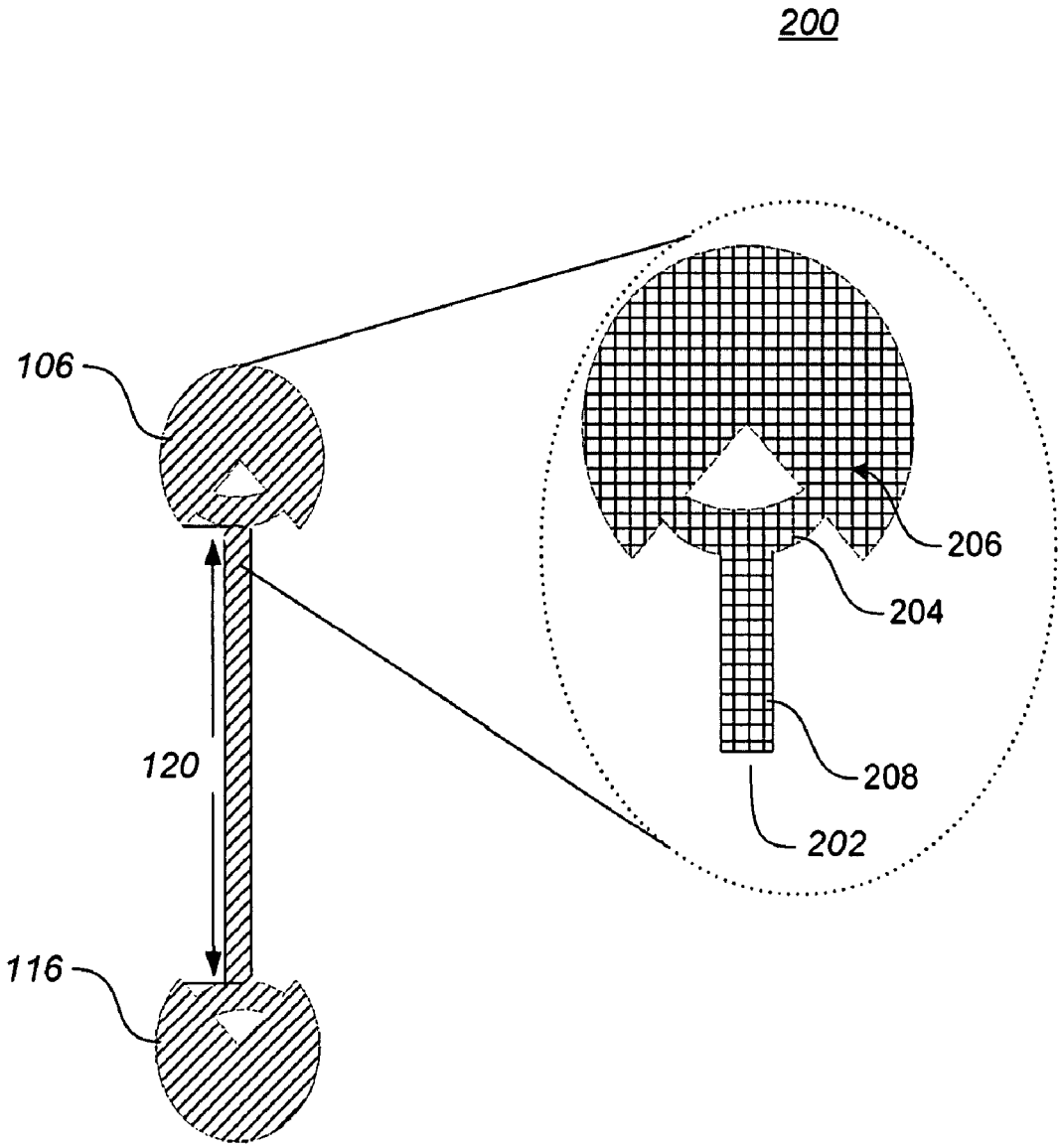
FIG. 2 is an illustration of a slotline with a first and second slotline stepped circular ring (SCR) according to an embodiment.

FIG. 2 is an illustration of slotline SCR 200 having a slotline 120 with a first SCR 106 and second SCR 116 coupled at each end. The slotline SCR 106 and 116 comprises three slotline sections 204, 206, 208 with the characteristic admittances, physical lengths, and electrical lengths. Due to symmetry, the circular structure forces the electric field (E-field) at input 202 to cancel at center, creating low-loss virtual ground over the operating band. The slotline SCRs (106, 116) are used in Magic-T 100 as terminations for the microstrip-to-slotline transition so as to cause a virtual ground when the signals from the first input port 110 and second input port 112 are out-of-phase. The slotline SCR cause a virtual ground when the input signals (110, 112) are in-phase.

Figure 3:
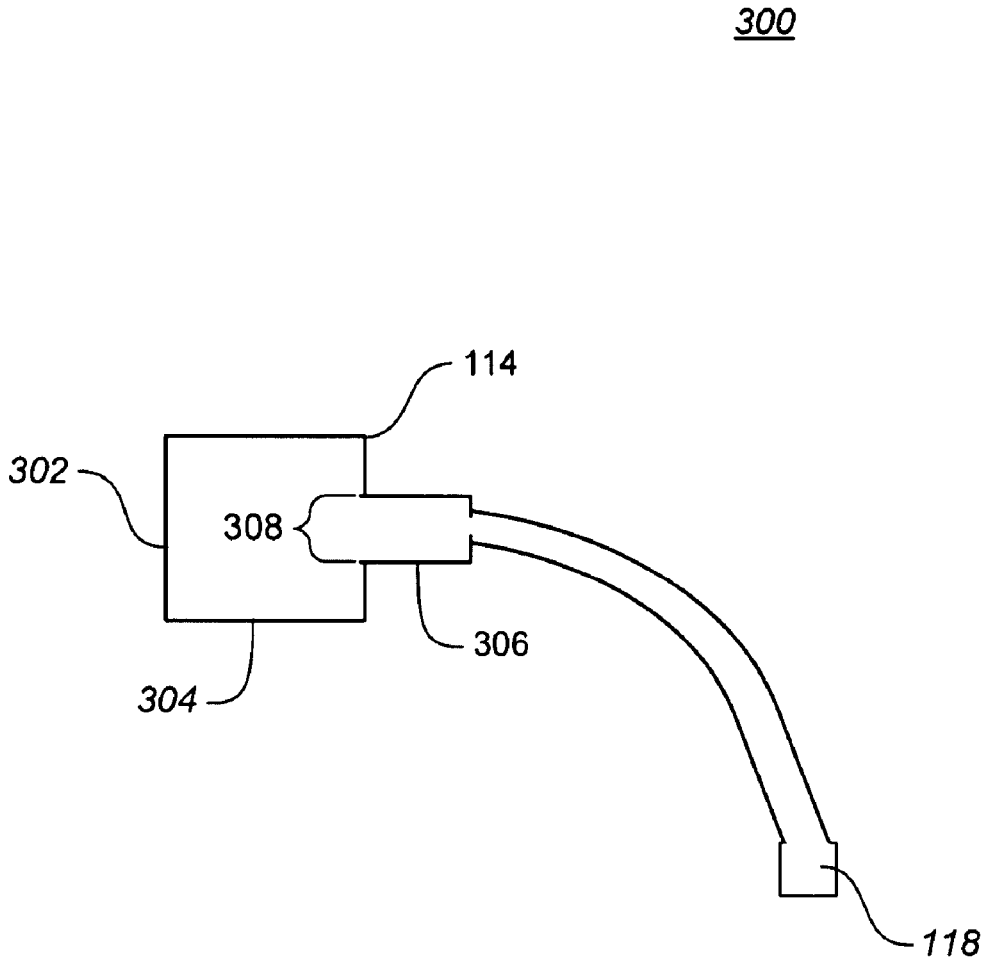
FIG. 3 is an illustration of a microstrip stepped impedance open-end stub according to an embodiment.

FIG. 3 is an illustration of a microstrip stepped impedance opened (SIO) stub 300 in accordance to an embodiment. The SIO stub 114 is comprise of microstrip lines with characteristic impedances and associated electrical lengths. The impedance of the SIO $Z_{t1}$ and $Z_{t2}$ have the physical widths and lengths of $W_{t1}$ (308) and $W_{t2}$ (302), and $L_{t1}$ (306) and $L_{t2}$ (304), respectively. These electrical lengths are tuned such that the SIO stub 114 provides a virtual ground at the fundamental frequency ($f_o$). When the SIO stub 114 is connected to parallel line with the characteristic impedance of $2Z_1$, the SIO stub forms a grounded-end anti-parallel coupler having $2Z_1$,e and $2Z_{1,o}$ as even- and odd-mode characteristic impedance.

Figure 6:
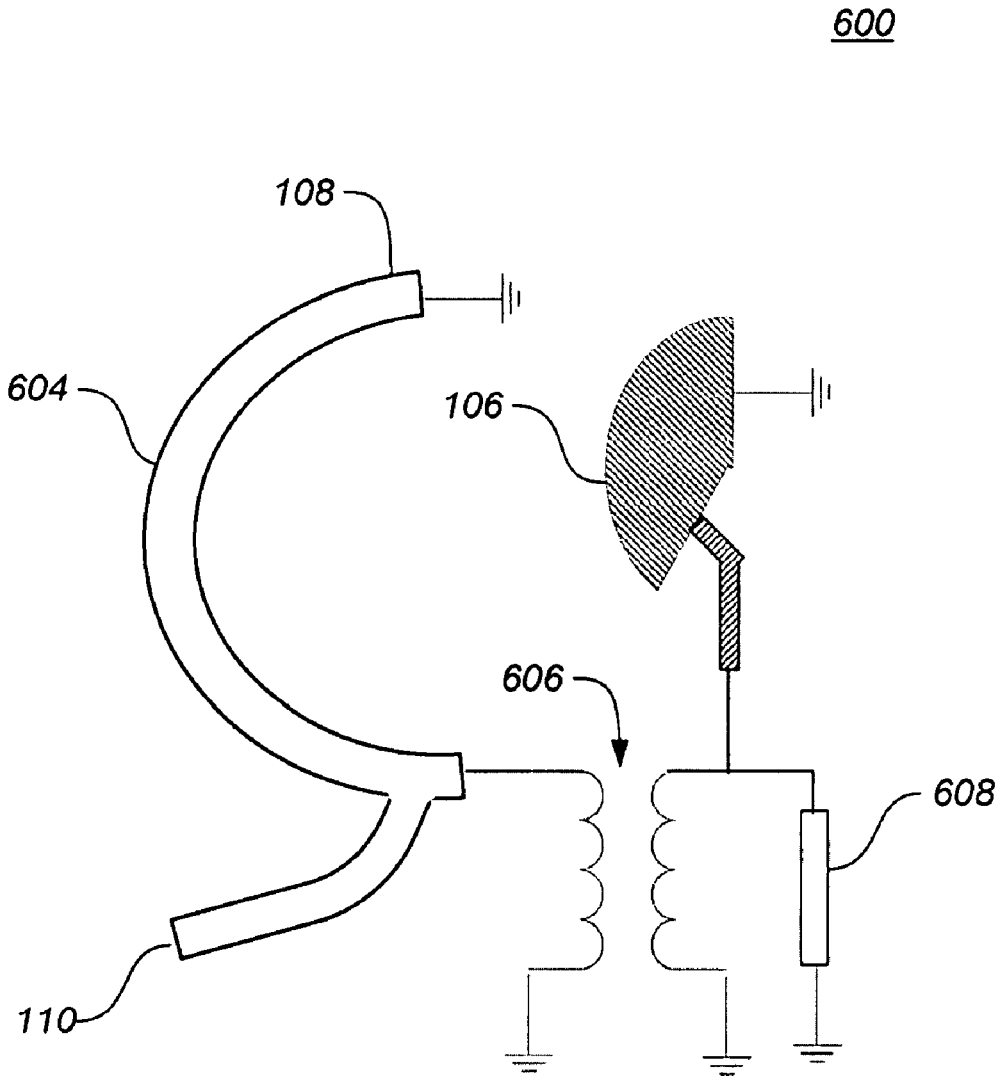
FIG. 6 is an illustration of an equivalent circuit in an odd mode according to an embodiment.

The slotline SCR termination 106 can be modeled as stepped impedance transmission lines, for example, as shown in FIG. 6. Its equivalent circuit parameters and its physical parameters designed on 0.25 mm-thick Duriod 6010 substrate are provided in Table I and Table II, respectively.

TABLE I

The Magic-T Circuit Design Parameters at 10 GHZ

| MICROSTRIP LINE SECTION | SLOTLINE SECTION |
|---|---|
| $Z_1 = 42.7\ \Omega$, $Z_2 = 60.33\ \Omega$, $Z_{t1} = 40\ \Omega$, $Z_{t2} = 20\ \Omega$, $\theta_{t1} = 23{,}3°$, $\theta_{t2} = 46.6°$ | $Z_s = 72.8\ \Omega$, $Z_{sl0} = 72.8\ \Omega$, $Z_{sl1} = 163.4\ \Omega$, $Z_{sl2} = 72.8\ \Omega$, $\theta_{sl0} = 13.57°$, $\theta_{sl2} = 6.2°$, $\theta_{sl1} = 34.95°$, $\theta_s = 113.3°$ |

TABLE II

The Physical Parameters of the Compact Magic-T in Millimeters

| Microstrip line section | Slotline section |
|---|---|
| $L_1 = 2.62$, $W_1 = .26$, $L_2 = 1.83$, $W_2 = 0.14$, $L_t = 2.8$, $W_t = 0.16$, $L_{t1} = 0.68$, $W_{t1} = 0.37$, $W_{t1} = 0.37$, $L_{t2} = 1.30$, $W_{t2} = 1.05$ | $L_s = 1.92$, $W_s = 0.10$, $L_{so} = 0.58$, $W_{so} = 0.10$, $L_{s1} = 0.23$, $W_{s1} = 0.10$, $L_{s2} = 0.91$, $W_{s2} = 0.71$ |

In the odd mode, the signals from the first port 110 and second port 112 are out-of-phase. This creates a microstrip virtual ground plane along the Y-axis 124 of the Magic-T 100. The slotline SCR (120,116) connected to the slotline 120 ($Z_{SL}$), also allows the MS-SL mode conversion to occurs as demonstrated by the electric-field (E-field) and current directions around the X-axis cross section as shown by 402 in FIG. 4.

Figure 4:
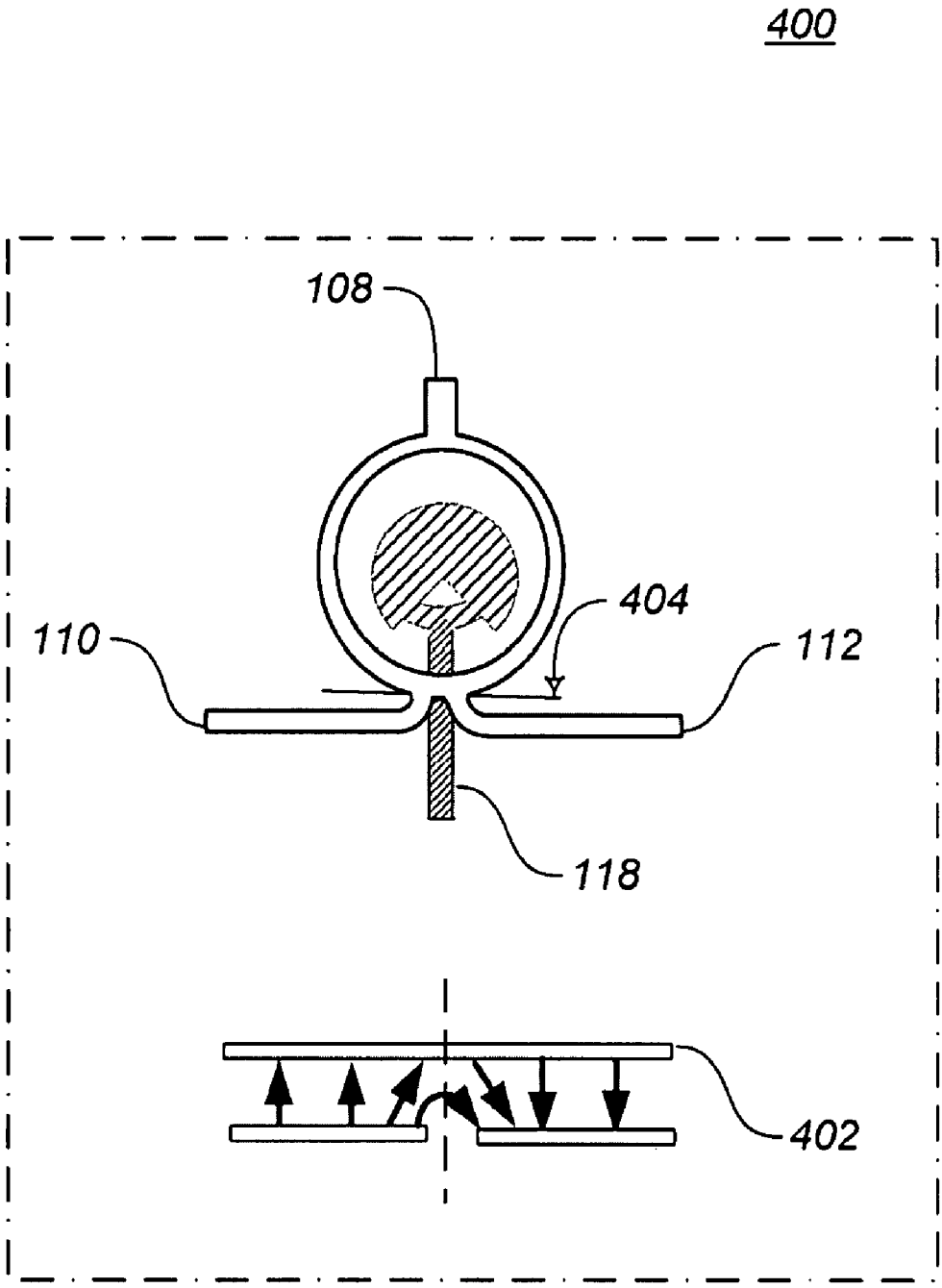
FIG. 4 is an illustration of the electric fields across a microstrip in the odd mode according to an embodiment.
Figure 5:
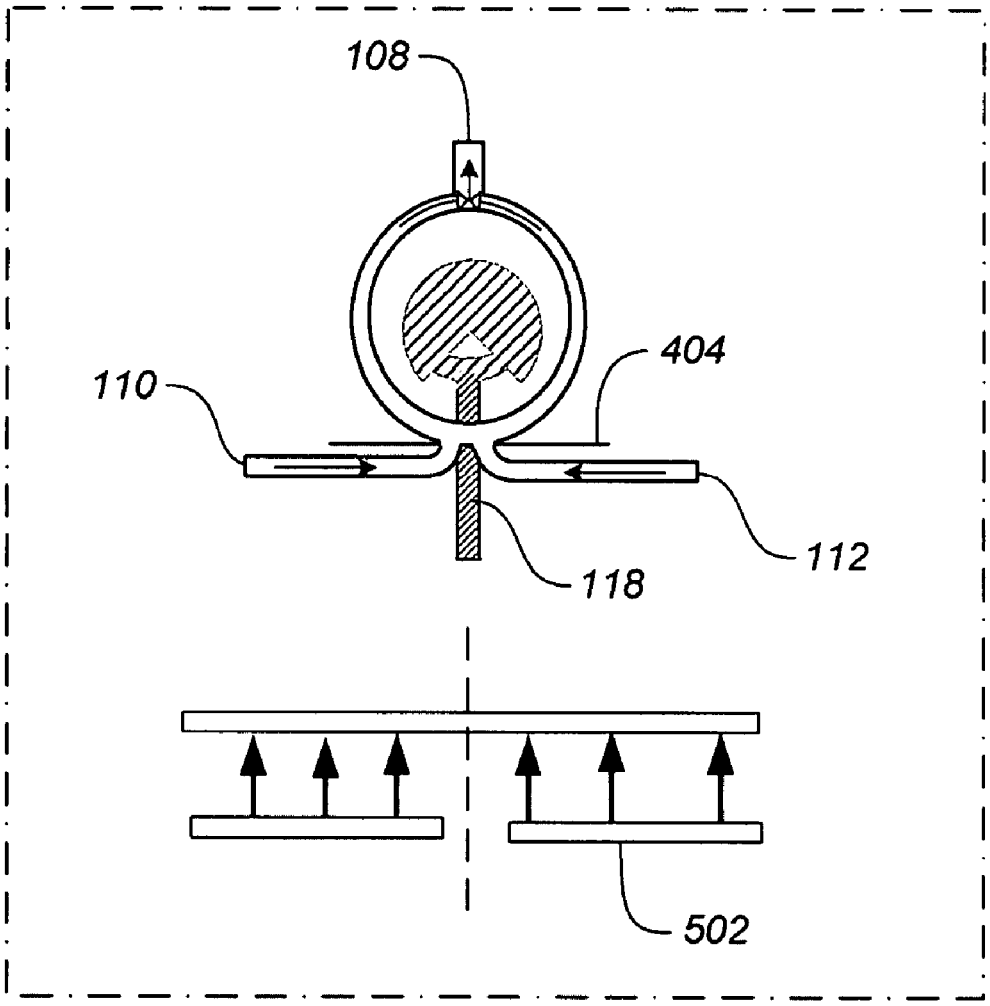
FIG. 5 is an illustration of electric fields across a microstrip in an even mode according to an embodiment.

In the even mode, the signals from the first port 110 and second port 112 are in-phase, thus creating a microstrip virtual open along the Y-axis 124 of the Magic-T 100 as shown in FIG. 4. The electric fields (502 at FIG. 5) in the slotline at the MS-SL tee junction 404 along X-plane are canceled creating a slotline virtual ground that prevents the signal flow to or from port 118.

FIG. 6 is an illustration of the circuit model for Magic-T 100 in the odd mode. As noted earlier, the odd mode occurs when the signals from the first port 110 and the second port 112 are out-of-phase. The impedance of the first port 110 is labeled 602, the connecting impedance to port 108 is labeled as 604, and the half impedance of the line from the SIO to input/output port 118 is labeled as 608. In order to match the impedance of the four ports of the Magic-T (110, 112, 108, 118), the Magic-T 100 is analyzed at the center frequency in odd-mode and even-mode circuits up to the MS-SL tee junction 404. The odd mode circuit model the λ/4 line ($Z_1$ or the impedance at the first port 110) is used to transform the input characteristic impedance at the first port 110 to the desired impedance value of $Z_S/2$ (608) of the slotline 120. The slotline SCR 106 has no effect on the circuit at the center frequency since it is a virtual open at that frequency. Therefore, $Z_1$ can be derived as follows:

$$Z_1 = \sqrt{N_t^2 \cdot \frac{Z_S}{2} \cdot Z_0} \qquad \text{EQ. 1}$$

where $N_1$, is the MS-SL transformer ratio. The λ/4 line $Z_2$ (the impedance at output port 108) is used to transform the grounded-end at port 108 to a virtual open at $Z_S$. The practical value of $Z_2$ is set by the impedance matching in the even-mode analysis.

Figure 7:
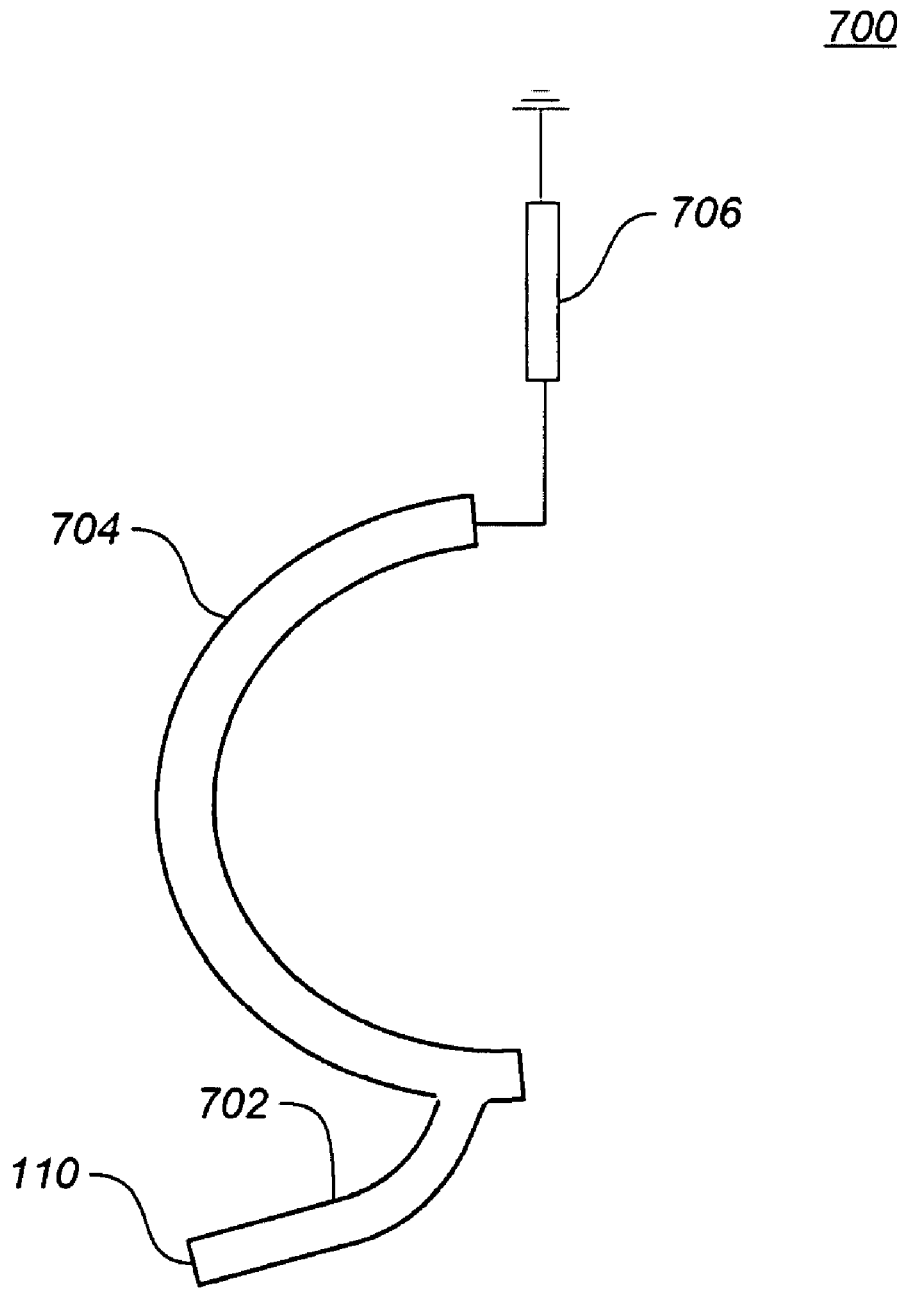
FIG. 7 is an illustration of an equivalent circuit in an even mode according to an embodiment.

FIG. 7 is an illustration of the circuit model for Magic-T 100 in the even mode. As noted earlier, the even mode occurs when the signals from the first port 110 and the second port 112 are in-phase. The impedance of the first port 110 is labeled 702, the connecting impedance to port 108 is labeled as 704. Since a slotline virtual ground is created input/output port 118 is isolated from the rest of the other ports. In the even mode, the input impedance $Z_0$ at port 1 is transformed to the in-phase port impedance of $2Z_0$ at 706. Since the line $Z_1$ is used to transform impedance $Z_0$ to $Z_S/2$ in odd-mode, the line $Z_2$ transforms the odd-mode impedance of $Z_S/2$ to $2Z_0$ at 706. Therefore, $Z_2$ can be computed as follows:

$$Z_2 = \sqrt{2Z_0 \cdot N_t^2 \cdot \frac{Z_S}{2}} = \sqrt{2}\, Z_1 \qquad \text{EQ. 2}$$

The isolation between the first port 110 and the second port 112 and the return loss of the first port and the second port are derived in term of the reflective coefficients ($\Gamma_{+-}$ and $\Gamma_{++}$) and defined as follows:

$$\text{Isolation} = -20\log\left(\frac{|\Gamma_{++} - \Gamma_{+-}|}{2}\right) \qquad \text{EQ. 3}$$

$$\text{Return loss} = -20\log\left(\frac{|\Gamma_{++} + \Gamma_{+-}|}{2}\right). \qquad \text{EQ. 4}$$

In an exemplary design, for example, a Magic-T 100 is designed on a 0.25 mm-thick Duroid 6010 substrate with the dielectric constant of 10.2. The slotline is 0.1 mm wide. This corresponds to the $Z_S$, value of 72.8 Ohm. Given $Z_0$=50 Ohm and $N_1$=1, from EQ. 1 and EQ. 2, we obtain $Z_1$ and $Z_2$ of 42.7 Ohm and 60.4 Ohm, respectively.

Figure 8:
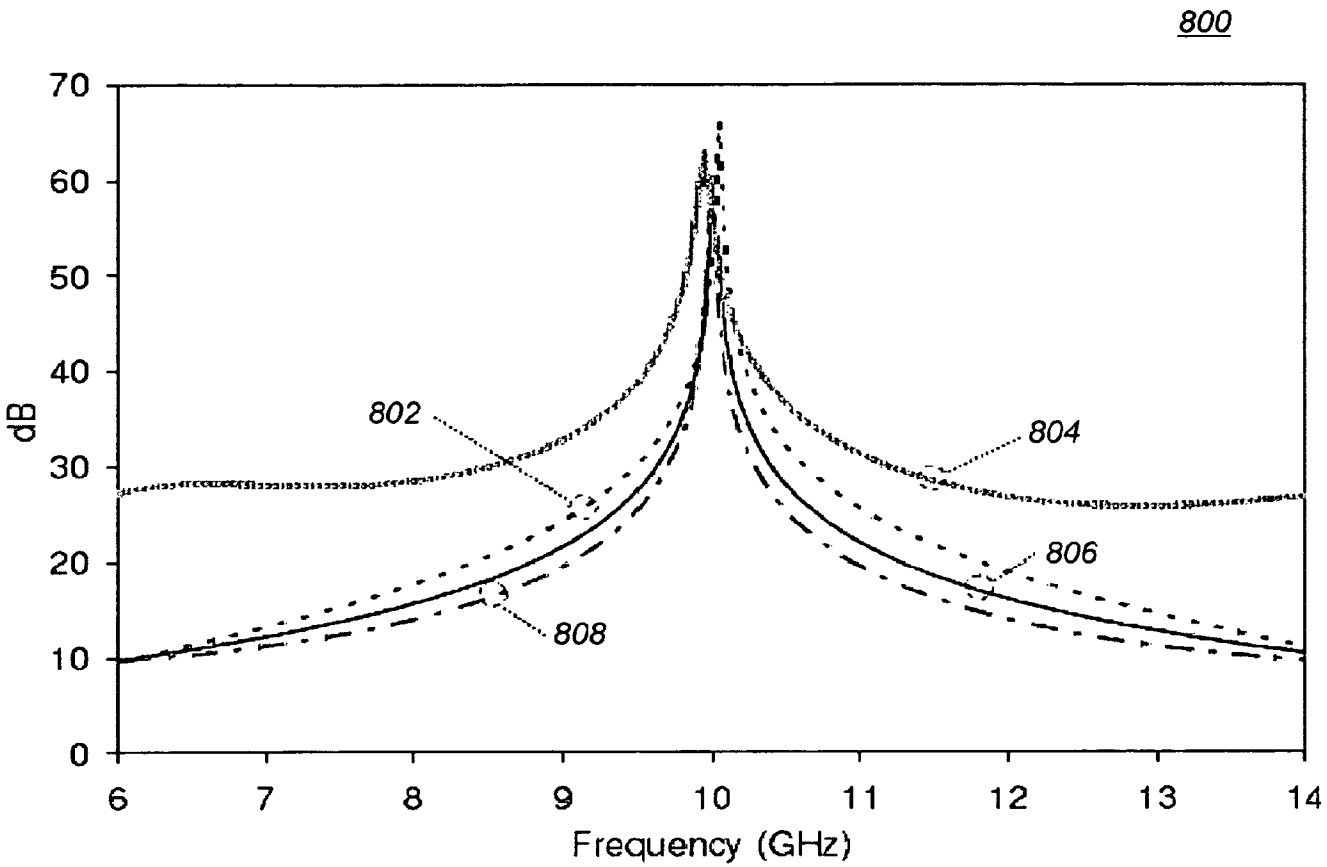
FIG. 8 is an illustration of the frequency response for the Magic-T according to an embodiment.

Using the circuit model in FIGS. 6 and 7, and the parameters at 10 GHz in Table I (infra), the Magic-T 100 frequency response to the tee junction is shown in FIG. 8. In particular, FIG. 8 shows the frequency response of Magic-T 100 using odd and even-mode circuit model. Label 802 shows the return loss of the difference port (118), label 804 shows the return loss of the first port 110, label 806 shows the isolation between the first and second ports, and label 808 shows the return loss of the sum port 108. Magic-T 100 provides better broadband out-of-phase combining response than the in-phase combining response. The in-phase combining bandwidth is limited by the two impedance transformation sections in $Z_1$ and $Z_2$ used to transform $Z_0$ at first port 110 to 2 $Z_0$ at port 108 (sum port) in even mode. Moreover, the $Z_2$ value needs to satisfy the odd-mode matching condition.

CONCLUSION

In particular, one of skill in the art will readily appreciate that the names of the methods and apparatus are not intended to limit embodiments. Furthermore, additional methods and apparatus can be added to the components, functions can be rearranged among the components, and new components to correspond to future enhancements and physical devices used in embodiments can be introduced without departing from the scope of embodiments.

While the invention has been described in conjunction with specific embodiments therefor, it is evident that various changes and modifications may be made, and the equivalents substituted for elements thereof without departing from the true scope of the invention. In addition, many modifications may be made to adapt a particular situation or material to the teachings of the invention without departing from the scope thereof. Therefore, it is intended that this invention not be limited to the particular embodiment disclosed herein, but will include all embodiments within the spirit and scope of the disclosure. The terminology used in this application meant to include all waveguide, slotlines and microstrip slotline transitions environments and alternate technologies which provide the same functionality as described herein. For example, while the Magic-T has been described with planar waveguide circuits, retrace hybrids with microstrip coplanar waveguide transitions would be suitable alternatives.

We claim:

1. A four-port circuit for processing two incoming signals of arbitrary phase and amplitude to output two corresponding output signals, comprising: a first input port and a second input port for receiving respective first and second incoming signals of arbitrary phase and amplitude; a first output port and second output port at which first and second output signals are provided; first and second quarter-wavelength microstrip line segments connected to a junction node and in series between the first input port and the first output port; third and fourth quarter-wavelength microstrip line segments connected to the junction node and in series between the second input port and the first output port; a fifth quarter-wavelength microstrip line segments connected to the second output port; and a slotline having a first and second end terminated with slotline stepped circular ring (SCR) so that the input signals are combined at the junction node when the first and second incoming signals are out-of-phase, and wherein the first and second incoming signals are combined at the first output port when the first and second incoming signals are in-phase.

2. The four-port circuit of claim 1 further comprising: a microstrip stepped impedance open-end (SIO) stub coupled to the second output port.

3. The four-port circuit of claim 1, wherein the junction node is a microstrip slotline tee junction.

4. The four-port circuit of claim 1, wherein the second output port is isolated from other ports in the four-port circuit when the first and second incoming signals are in-phase.

5. The four-port circuit of claim 1, wherein the four-port circuit is a Magic-T.

6. A method of combining signals in a Magic-T, the method comprising: providing a Magic-T waveguide circuit element, wherein the Magic-T waveguide circuit element has a first input port, a second input port, and an output port; providing a microstrip slotline transition circuit, wherein the microstrip slotline transition circuit has an input/output port; providing a slotline having a first and second end coupling the Magic-T waveguide circuit element and the microstrip slotline transition circuit; causing a ground at the output port of the Magic-T when in an odd mode, wherein the odd mode occurs when received signals at the first input port and second input port are out-of-phase; and causing the input/output port at the provided microstrip slotline transition circuit to be isolated when in an even mode, wherein the even mode occurs when received signals at the first input port and second input port are in-phase.

7. The method of claim 6, the method further comprising: providing a first slotline stepped circular ring positioned within the Magic-T and coupled to one end of the slotline.

8. The method of claim 6, the method further comprising: providing a second slotline stepped circular ring positioned within the microstrip slotline transition circuit and coupled to one end of the slotline.

9. The method of claim 6, the method further comprising: providing a microstrip stepped impedance open-end (SIO) stub coupled to one end of the input/output port.

10. The method of claim 8, wherein the slotline and the Magic-T waveguide circuit element form a microstrip slotline tee junction at the point of coupling.

11. The method of claim 10, the method further comprising: combining at the microstrip slotline tee junction out-of-phase received signals at the first input port and second input port.

* * * * *